US005509226A

United States Patent [19]

Houde-Walter

[11] Patent Number: 5,509,226

[45] Date of Patent: Apr. 23, 1996

[54] FIREARM WITH MODIFIED TAKE DOWN LATCH FOR CONTROLLING LASER SIGHT

[75] Inventor: William R. Houde-Walter, Rush, N.Y.

[73] Assignee: LaserMax Incorporated, Rochester, N.Y.

[21] Appl. No.: 148,846

[22] Filed: Nov. 8, 1993

[51] Int. Cl.[6] ..... F41G 1/35; F41G 1/36

[52] U.S. Cl. ..... 42/103; 362/110

[58] Field of Search ..... 42/103; 33/241; 362/110, 111, 112, 113, 114

[56] References Cited

U.S. PATENT DOCUMENTS

| | | | |
|---|---|---|---|
| 1,452,651 | 4/1923 | Norrlin | 362/110 |
| 3,513,581 | 5/1970 | Slater | 42/103 |
| 3,573,868 | 6/1971 | Giannetti | 273/101.1 |
| 4,026,054 | 5/1977 | Snyder | 42/103 |
| 4,161,076 | 7/1979 | Snyder | 362/110 |
| 4,541,689 | 9/1985 | Howard et al. | 350/255 |
| 4,627,183 | 12/1986 | Stuckman | 362/110 |
| 4,678,288 | 7/1987 | Lonsdale et al. | 250/566 |
| 4,694,182 | 9/1987 | Howard | 250/566 |
| 4,731,795 | 3/1988 | Clark et al. | 372/107 |
| 4,777,754 | 10/1988 | Reynolds | 42/103 |
| 4,884,275 | 11/1989 | Simms | 372/9 |
| 4,897,850 | 1/1990 | Crosby | 372/107 |
| 4,910,741 | 3/1990 | Pillsbury et al. | 372/109 |
| 4,916,579 | 4/1990 | Simms | 362/18 |
| 4,916,713 | 4/1990 | Gerber | 372/107 |
| 4,934,086 | 6/1990 | Houde-Walter | 42/103 |
| 5,111,476 | 5/1992 | Hollenbeck et al. | 372/107 |
| 5,119,576 | 6/1992 | Erning | 362/111 |
| 5,121,188 | 6/1992 | Patridge | 357/74 |
| 5,179,235 | 1/1993 | Toole | 362/110 |
| 5,237,773 | 8/1993 | Claridge | 42/103 |
| 5,351,429 | 10/1994 | Ford | 42/103 |
| 5,355,608 | 10/1994 | Teetzel | 42/103 |
| 5,388,364 | 2/1995 | Paldino | 42/103 |
| 5,392,550 | 2/1995 | Moore et al. | 42/103 |

FOREIGN PATENT DOCUMENTS 654655 2/1986 Switzerland .

OTHER PUBLICATIONS

Advertisement sheet on Sure–Fire, by Laser Products.
Advertisement sheet on Lasersight LS45 Laser Aiming System, by Imatronic, Inc.
Advertisement sheet entitled "A New Age of Lasersight Technology", by Gryphon Electronics, Inc.
Advertisement sheet, by American Made Mounts.
Four advertisement sheets on Aimtech pistol mounts, by L&S Technologies, Inc.
1988 Brochure of Spindler & Hoyer for Diode Lasers.
1989 Advertisement of Toshiba including a Holo–Spectra laser source.
Holo–Spectra specification sheet, undated.
1991 Affidavit of John B. Allen from the File History of U.S. Pat. No. 5,121,188.
Statement of Prior Art from the File History of U.S. Pat. No. 5,121,188.

*Primary Examiner*—Stephen M. Johnson
*Attorney, Agent, or Firm*—Eugene Stephens & Associates

[57] ABSTRACT

A laser sight 33 in a pistol 20 includes a battery power supply 34, driver board 38 and laser 27 in a casing 11. The laser 27 is energized when a take down latch 36 is moved to the left or right. In a center position, take down 46 in the middle of the latch 36 contacts a ball tip electrical contact 41 that extends through end cap 35 of laser sight 33 and disconnects the laser 27 from the power supply 34.

6 Claims, 7 Drawing Sheets

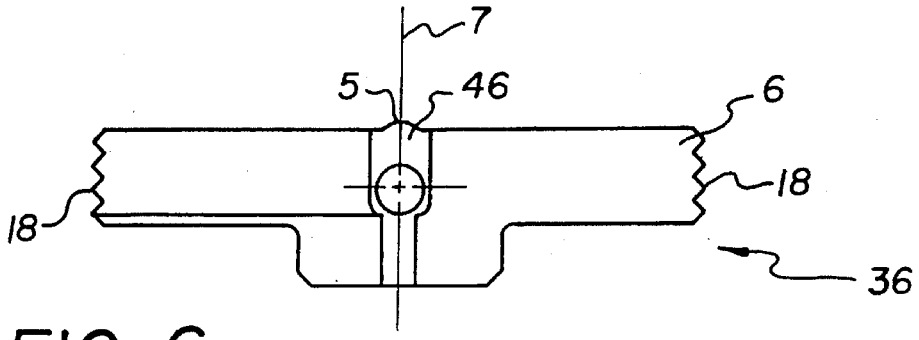
FIG. 6a
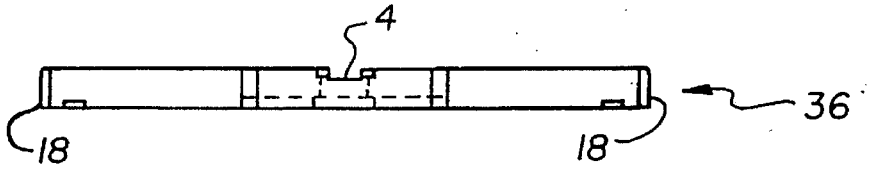
FIG. 6b
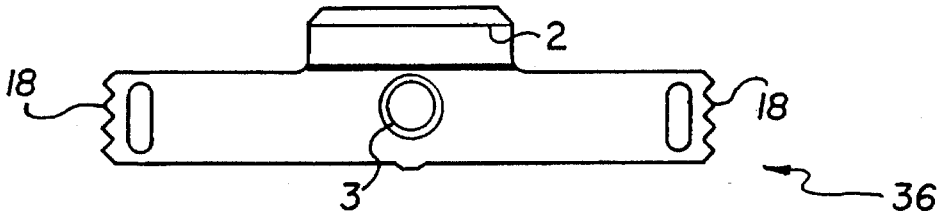
FIG. 6c
FIG. 6d
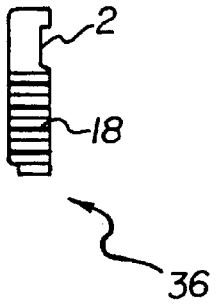

FIREARM WITH MODIFIED TAKE DOWN LATCH FOR CONTROLLING LASER SIGHT

This invention relates, in general, to laser sights for firearms, and, in particular, to self-aligned laser sights which are easily installed, are ambidextrously operated, and have prolonged battery life.

BACKGROUND

In U.S. Pat. No. 4,934,086, there is shown a firearm, in particular a pistol, in which a laser sight is mounted in a recoil spring guide chamber. Laser sights are often used by law enforcement authorities in order to enhance the negotiating position of a law enforcement officer when confronting a party subject to arrest. It is reported that once a party subject to arrest recognizes that the party has been targeted with a laser sight, such parties often cease further resistance to arrest and relinquish their own firearms. So, there is a need for a laser sight in such situations.

Certain firearms are not equipped with safety latches. Law enforcement officers are trained to withdraw such a firearm from its holster and place a trigger finger along the recoil spring guide chamber of the firearm. Such technique reduces the cases of inadvertent firing of the firearm. However, it would be desirable to provide the law enforcement officer with a positive reinforcement for this training technique.

There is also a need for a laser sight which may be quickly installed in a pistol without requiring substantial modification of the firearm. Until now, most laser sights for pistols have been accessories that are added by the pistol owner and not by the manufacturer. Such laser sight accessories often require substantial modification of the pistol in order to accommodate the laser sight. In some cases, the modification is so extensive that the pistol manufacturer will not further honor the original warranty that was made in connection with the sale of the pistol. As such, it is desirable to have a laser sight accessory which requires minimal modifications of the pistol so that the original manufacturer warranty is maintained and so that the laser sight can be rapidly installed by the pistol owner or user without requiring installation by a trained technician.

There has also developed a need for a long lasting laser sight. Because current lasers require substantial power, laser sights have been of unduly large size in order to accommodate power supplies needed to maintain the laser in an operating condition for a reasonable amount of time. i.e., one hour or more. So, the users of laser sights have been faced with the dilemma of shrinking the size of the laser sight but reducing the overall operating life of the battery or having a larger sight that can accommodate a larger battery and thus a longer life. As such, there is a need for a relatively small laser sight with a small power source or battery that lasts for an hour or more.

SUMMARY

The invention described herein meets the needs expressed above. In the invention, a laser sight having a power source is disposed substantially entirely within the recoil spring guide chamber of a firearm, such as the recoil cavity of a pistol. The laser sight is itself contained in an elongated housing having at one end a window through which a laser beam is emitted and at the other end a battery cap. The battery cap has several significant features. For one, it has a key at its end which fits into a slot in the recoil chamber. The slot already exists in the recoil chamber of the pistol and the key on the laser sight enables the user to quickly insert the laser sight into the recoil cavity and have the laser sight aligned by using the existing slot. The battery cap is made of insulating material of a soft polymer that is adapted to absorb the recoil shock of the reciprocating firing chamber. On the tip of the battery cap is a ball tip connector that establishes electrical connection as described later.

The take down latch of the firearm is modified to control the laser. The take down latch has a central, insulating portion. The center portion with insulating material keeps the laser off. When the take down latch is moved to the left or to the right, the metal of the latch contacts the ball tip of the battery cap thereby establishing a completed electrical connection turning on the laser. As such, when a law enforcement officer places his/her finger adjacent the trigger guard and on the take down latch, a slight inward pressure on the take down latch will turn on the laser and provide positive reinforcement for such safety procedure. The take down latch can move either left or right in order to turn on the laser so as to accommodate either right-handed or left-handed users. Since the centered position is the off position for the laser, the take down latch will automatically re-center itself and shut off the laser when inserted into a holster. That is, the sides of the holster will urge the take down latch towards its center position thereby turning off the laser.

Still another feature of the invention is that the driving circuitry of the laser is designed to operate the laser in a flashing mode of operation. This flashing mode of operation conserves the power of the laser while still providing a highly visible beam. Indeed, the flashing of the laser is chosen to be at a predetermined frequency that is most recognizable to the human eye. This frequency may be preferably between 8 and 12 Hz and is preferably at about a frequency of 10 Hz. This frequency is chosen so that the batteries in the laser are flashed at a predetermined rate and operated at a predetermined duty cycle, preferably between 10–20%, to permit the batteries to refresh themselves between laser flashes and to reduce the energy drain of the batteries.

BRIEF DESCRIPTION OF THE DRAWINGS

FIGS. 6*a*–6*d* are views of the take down latch;

DETAILED DESCRIPTION OF THE DRAWINGS

Figure 1:
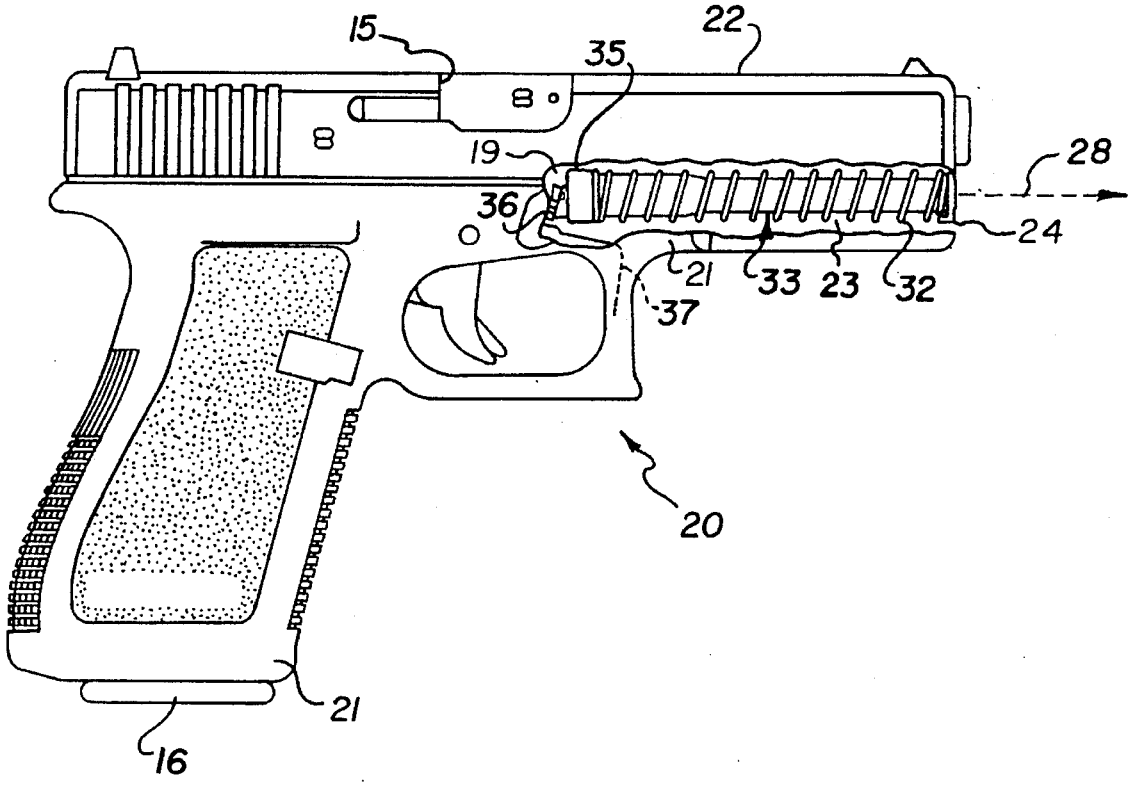
FIG. 1 is a partially cut away view of a firearm.

With reference to FIG. 1 there is generally shown a firearm 20. Typical of such a firearm is the Glock 17/171/

18/19/20/21 and 22 manufactured by Glock, GMBH of Austria. The pistol 20 is a semi-automatic device. The pistol grip frame 21 holds the magazine 16 which contains a number of rounds of ammunition. The ammunition is spring biased in a direction toward the structure 22 containing a reciprocating chamber. Cartridges from spent rounds are ejected through ejection slot 15 of structure 22 when the structure moves to the left or backward with respect to the frame 21 under the recoil action following discharge of the pistol 20. The structure 22 is coupled to the pistol grip frame 21 via a take down latch 36 which is mated to a catch 19 that is integral with the structure 22. Disposed between the structure 22 and the frame 21 is a recoil chamber 23. Within recoil chamber 23 is a laser sight 33 surrounded by a recoil spring 32. The recoil spring 32 extends between one end of the recoil chamber and an annular seat 45 (FIG. 3) of the laser sight 33. One of the features of the invention is that the recoil chamber 23 can be readily modified to accept a laser sight kit consisting of the elements illustrated in FIG. 2.

Figure 2:
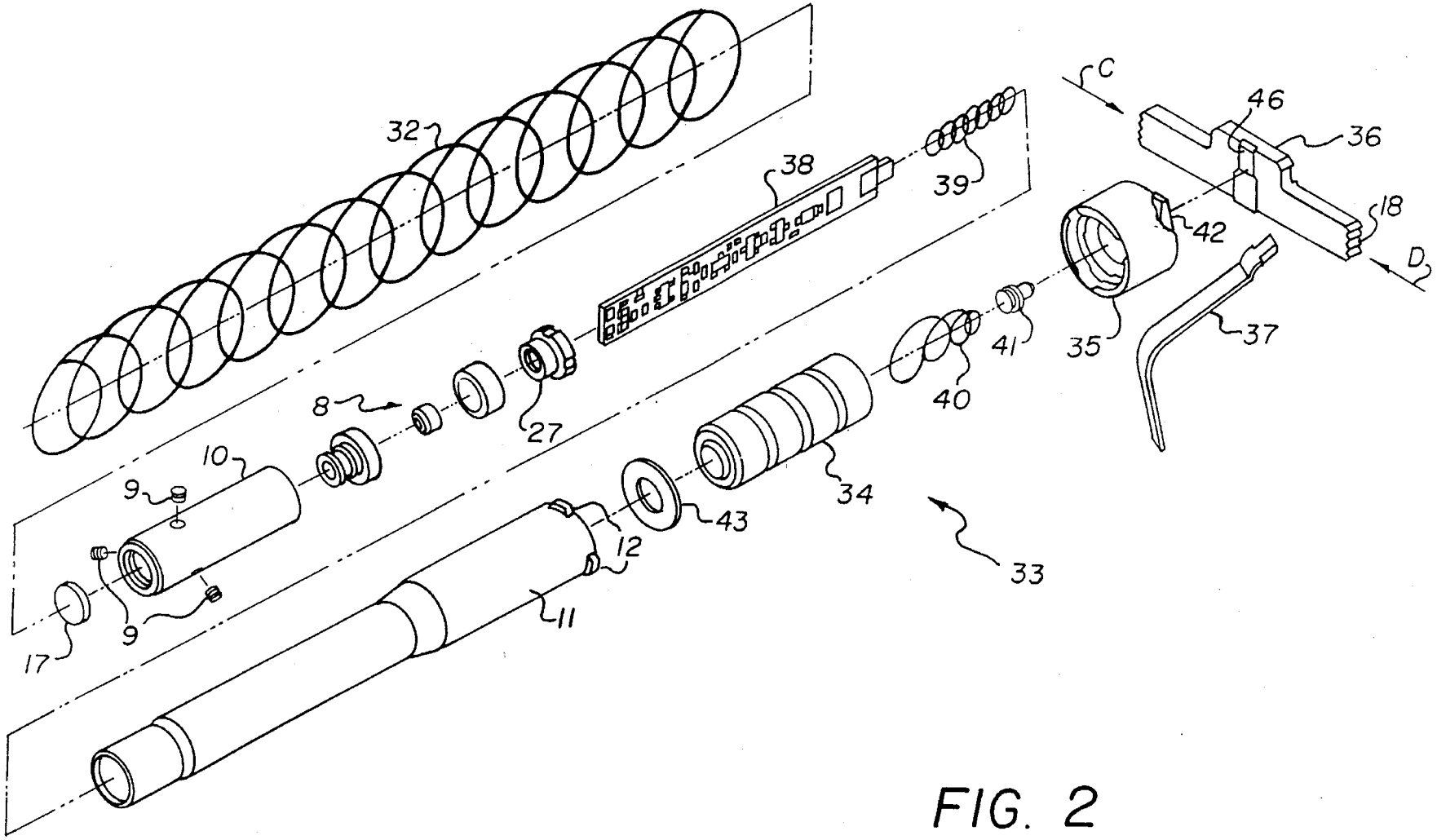
FIG. 2 is an exploded perspective view of the laser sight components added to the firearm.

Turning to FIG. 2, there is shown a laser sight 33 which includes a battery 34 that sits in one end of casing 11 of the laser sight 33 and is enclosed therein by an end cap 35 with a ball tip electrical contact 41. Cap 35 is made of insulating material, preferably a soft polymer capable of absorbing the recoil shock of the reciprocating chamber 22. Cap 35 has internal recesses that receives lugs 12 of laser sight casing 11. Recoil spring 32 fits around the casing 11 of laser sight 33. The original take down latch, not shown, is replaced by the inventive take down latch 36 and the modified take down latch spring 37. The spring 37 biases the latch 36 against the catch of the structure 22. The take down latch 36 is generally made of metal but has a central, insulated portion 46. In its normal, centered position, the take down latch 36 has its insulated portion 46 bearing against the ball tip electrical contact 41 of the cap 35 thereby interrupting the power to the laser sight 33 and maintaining the laser in an off condition. However, movement of the take down latch 36 to either the right as indicated by arrow C or to the left as indicated by arrow D will bring the metallic or electrically conductive portion of the take down latch 36 into contact with the ball tip 41 thereby completing the circuit through the battery 34 in order to power the laser 33.

Figure 3:
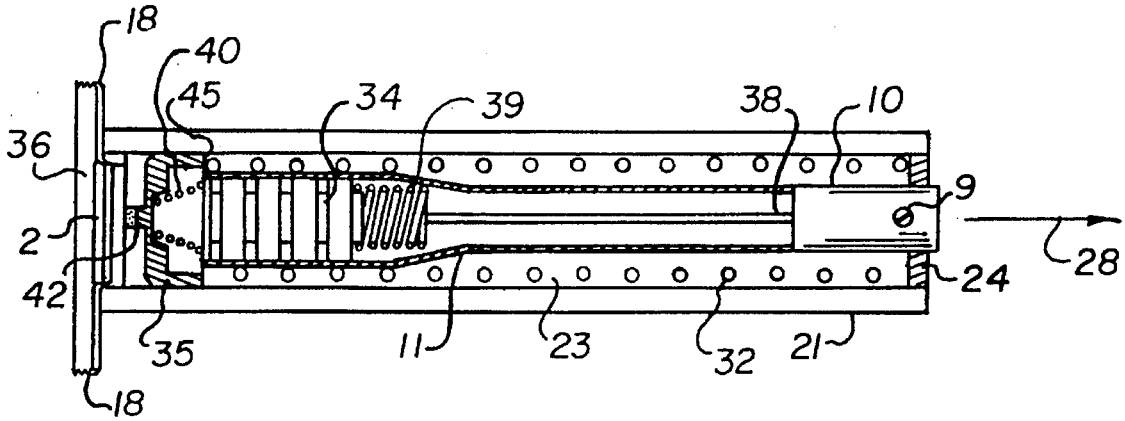
FIG. 3 is a partial sectional view of the recoil chamber with a laser sight installed.
Figure 4:
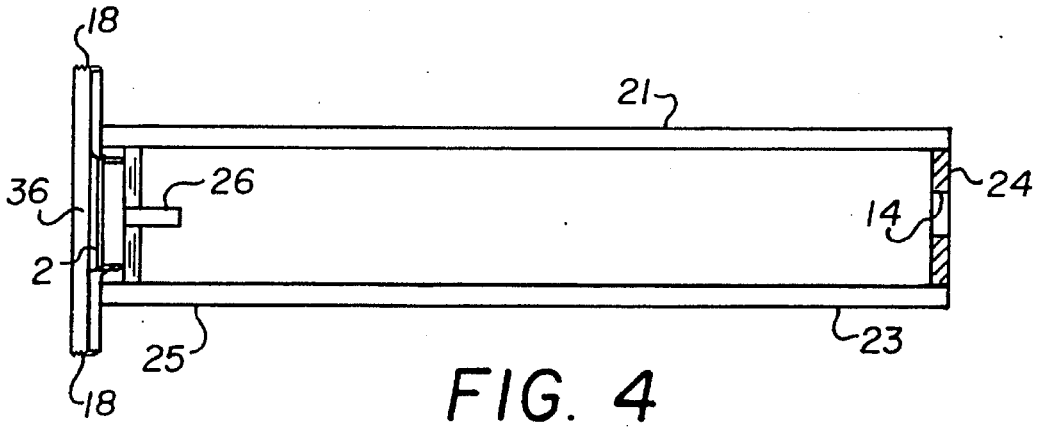
FIG. 4 is a partial sectional view similar to FIG. 3 without a laser sight.

FIG. 4 is a partial sectional view of the recoil chamber 23 shown in its empty condition. In this condition, the recoil chamber 23 has a central cavity with a partial closure at one end 24 with an opening 14 therein through which laser light in the form of a beam 28 will be emitted. At the other end of chamber 23 there is a slot 26. The slot 26 is angled and is designed to accept a key portion. The laser sight 33 as shown in FIG. 2 has a key portion 42 disposed on the end cap 35. The key portion 42 fits into the slot 26 to self-align the laser 33 within the recoil chamber 23 as shown in FIG. 3. There, the laser sight 33 is shown with recoil spring 32 disposed between one end 24 of the chamber 23 and an annular spring stop surface 45 of the end cap 35.

Returning to FIG. 2, the sight 33 has a lens housing 10. At one end there is a window 17. Set screws 9 adjust and align collimating lens 8 contained in lens housing 10. The lens housing 10 is press fit or otherwise suitably mounted on the casing 11. In line with the window 17 and lens 8 is a laser 27 such as a laser diode. Coupled to the laser diode is a driver board 38 that provides both electrical power and control to flash the laser 27. Driver board 38 includes suitable electronic circuitry, including an oscillator for operating the laser 27 at a predetermined frequency and for a predetermined duty cycle. The circuitry is preferably of complementary metal oxide (CMOS) design which has relatively low power consumption and a controllable duty cycle. Driver board 38 is coupled via a spring wire connection 39 to a set of batteries 34. The batteries 34 are in turn coupled to the ball tip 41 in the end cap 35 via another spring wire 40.

Figure 7:
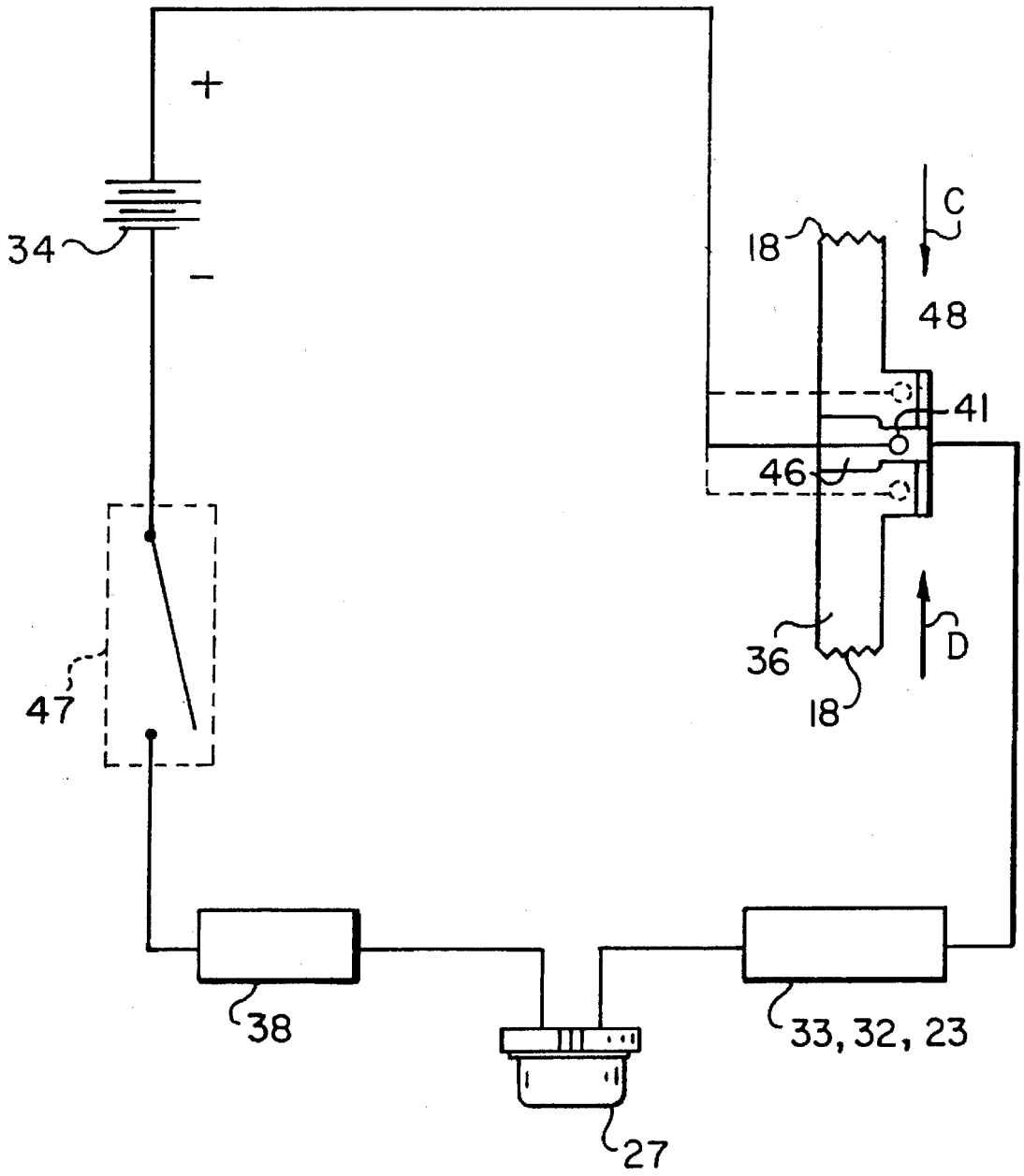
FIG. 7 is a combination electrical and mechanical schematic of the take down latch and laser sight circuitry.

With reference to FIG. 7, the laser diode 27 has one end connected electrically and mechanically to the take down latch 36 through the housing of laser sight 33, the recoil spring 32, and the recoil chamber 23. The other end of laser diode 27 is coupled to the driver board 38, optional switch 47, battery 34, and ball tip contact 41. When the take down latch 36 is in its normal or centered position, the insulated portion 46 of take down latch 36 opens the electrical circuit between the battery 34 and laser diode 27. When the take down latch 36 is moved either in the direction of arrow C or arrow D. i.e., to the left or to the right, then the ball tip 41 contacts the metallic portion 48 of the take down latch 36 and thereby establishes an electrical contact between the battery 34 and the laser 27.

The driver board 38 has suitable electronic circuitry for flashing the laser 27 at a predetermined rate. The laser is flashed because flashing will prolong the life of the battery 34. The battery 34 is preferably a silver oxide or lithium battery. Such batteries tend to refresh themselves between uses. Thus, the flashing of the laser diode 27 is also chosen to be at a frequency and duty cycle compatible with the refresh characteristic of the battery 34. Furthermore, the diode 27 is flashed at a frequency that is substantially recognizable to the human eye. Such frequency is between 8 and 12 Hz and is preferably at approximately 10 Hz. By flashing the battery on and off, the overall life of the silver oxide battery 34 is extended from a continuous use of about several minutes to an hour or more of flashing use.

Figure 5:
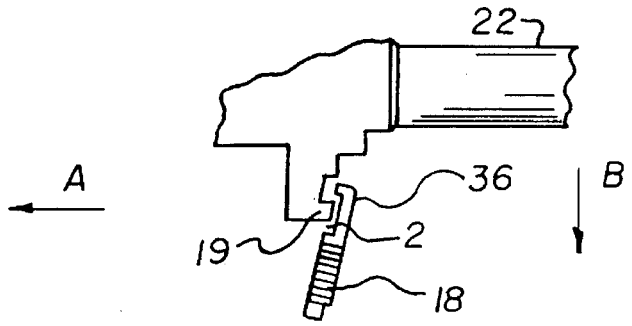
FIG. 5 is a partial sectional view of the take down latch and reciprocating chamber catch.

With reference to FIG. 5, there is shown the modified take down latch 36 coupled to catch 19 of the structure 22. When the structure 22 is moved slightly in the direction of arrow A, i.e., to the rear, then the take down latch may be moved in the direction of arrow B against the bias of spring 37. By holding the take down latch 36 below the catch 19, the latch may be slipped off the end of the structure 22 moved forward or in a direction opposite to the direction of arrow A.

With reference to FIGS. 6*a–d* the take down latch 36 is made from a steel blank. It is symmetrical about center line 7. Ridges 18 on both ends assist the user in manipulating the latch 36 horizontally and vertically. Insulating material 46 is disposed in the center of the latch 36 on face 6 that faces the ball tip contact 41. A rounded detent 5 helps keep the latch 36 in position until the latch is manipulated by a user. The detent 5 bears against a portion of the recoil chamber 23, not shown. Insulating material 46 fills a slot 4 and bore 3 that are machined into the metal latch 36. The material 46 is any suitable insulating material, preferably a moldable epoxy. Another slot 2 is machined to receive the catch 19 of the structure 22.

Figure 9:
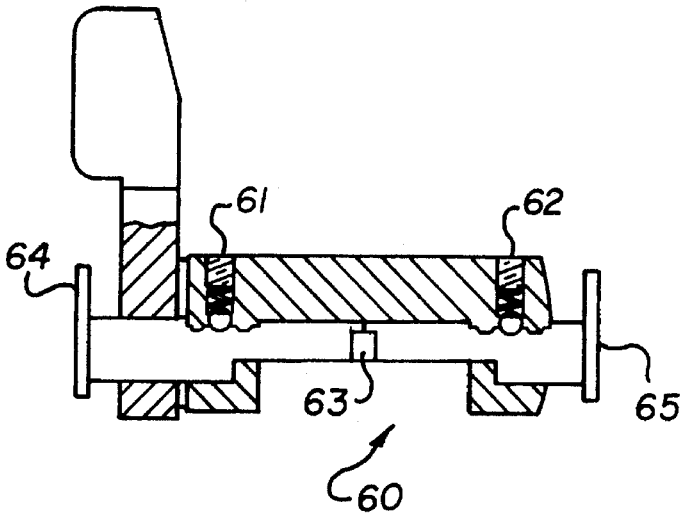
Figure 10:
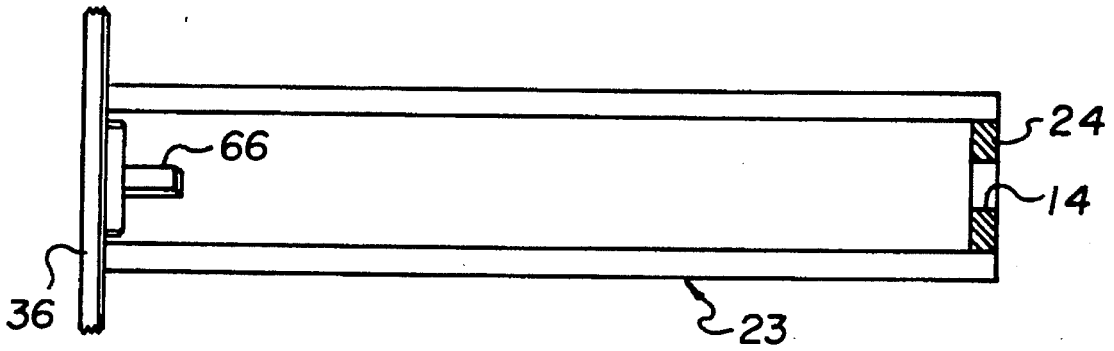
FIG. 10 is a partial sectional view of the recoil chamber of FIGS. 3 and 4 modified to replace a slot with a key.
Figure 11:
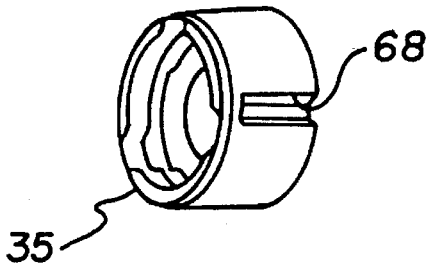
FIG. 11 is a perspective view of the cap of FIG. 2 modified to replace a key with a slot.

Those skilled in the art will appreciate further modifications, changes, additions, and omissions may be made to the above described embodiment without departing from the spirit and scope of the appending claims. In particular, those skilled in the art will recognize that the key and the slot configuration may be reversed so that the-reciprocating chamber 23 has a key 66 and the cap 35 has a slot 68 that accepts the key as shown in FIGS. 10 and 11. Those skilled in the art will also appreciate that other frequencies may be used to flash the laser in order to provide a highly recognizable beam and also prolong the life of the batteries. Those skilled in the art will also know that other lasers may be adapted to the laser sight including a surface emitting laser that may not require a collimating lens. It is also within the skill of those in the art to provide the invention in other firearms having take down latches of different configurations. For example, the take down latch of a pistol made by Beretta or SIG would have a general cylindrical shape and be adapted to have ball detents on each end to hold the latch in its left or right position. See FIG. 8 and 9 for examples of take down latches compatible with such firearms.

Figure 8:
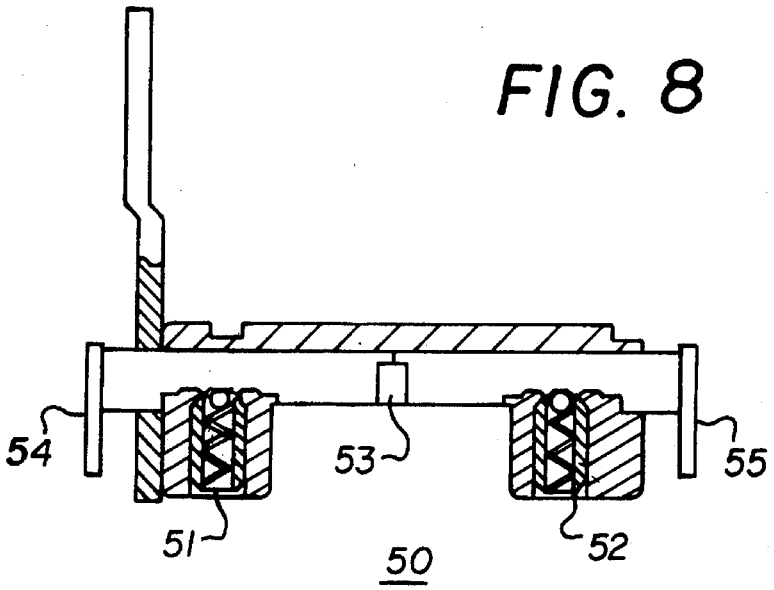
FIGS. 8 and 9 are alternate embodiments of the take down latch for other models of pistols.

In FIG. 8, a take down latch 50 is provided for a Sig Sauer pistol (not shown). The latch 50 has detents 51, 52 disposed on opposite ends. A center insulative portion 53 electrically uncouples the battery 34. External flanges 54, 55 are manipulated by the user's trigger finger to turn on the laser sight 33. A similar latch 60 for a Beretta pistol is shown in FIG. 9. There, ball type detents 61, 62 hold the latch 60 in place. Center portion 63 is made of insulating material and external flanges 64, 65 are used to move the latch 60 off center and turn on the laser 27.

What I claim is:

1. A firearm comprising a frame supporting a structure containing a reciprocating chamber, a recoil chamber formed between said structure and said frame, and a laser sight mounted in said recoil chamber, a take down latch disposed between said structure and said frame and moveable from a normal position for retaining said structure on said frame in a first direction for permitting the removal of said structure from said frame, said take down latch having an electrically conductive portion and an electrically insulating portion, said take down latch also being moveable from said normal position in a second direction for turning on said laser sight, an electrical circuit including said take down latch for supplying electrical energy to said laser sight through said take down latch when said latch is moved in said second direction and for terminating electrical energy to said laser sight when said latch is returned to said normal position.

2. The firearm of claim 1 wherein said second direction is transverse to a direction of movement of the support.

3. The firearm of claim 2 wherein said latch is moveable from said normal position in a third direction for turning on said laser sight.

4. The firearm of claim 1 wherein said take down latch is moveable from said normal position in a third direction and said electrically insulating portion divides said electrically conducting portion into two parts for turning on said laser when said latch is moved from said normal position in either of said second and third directions.

5. The firearm of claim 4 wherein said latch has a detent for holding said latch in said normal position.

6. The firearm of claim 1 wherein the laser sight has an end cap with an annular surface and a recoil spring surrounding the laser sight extends between the annular surface and one end of said recoil chamber.

* * * * *